United States Patent [19]

Olsen et al.

[11] Patent Number: 4,577,465

[45] Date of Patent: Mar. 25, 1986

[54] OIL FREE VACUUM SYSTEM

[75] Inventors: Donald A. Olsen, Millis; Michael J. Eacobacci, Randolph, both of Mass.

[73] Assignee: Helix Technology Corporation, Waltham, Mass.

[21] Appl. No.: 609,481

[22] Filed: May 11, 1984

[51] Int. Cl.[4] ..... B01D 8/00

[52] U.S. Cl. ..... 62/55.5; 62/100; 62/268; 55/269; 417/901

[58] Field of Search ..... 62/100, 268, 55.5; 55/269; 417/901

[56] References Cited

U.S. PATENT DOCUMENTS

| | | | |
|---|---|---|---|
| 3,010,285 | 11/1961 | Penn | 62/268 |
| 3,137,551 | 6/1964 | Mark | 62/55.5 |
| 3,262,279 | 7/1966 | Moore, Jr. | 62/55.5 |
| 3,485,054 | 12/1969 | Hogan | 62/55.5 |
| 3,630,051 | 12/1971 | Martin | 62/55.5 |
| 4,406,130 | 9/1983 | Hemmerich | 62/55.5 |
| 4,446,702 | 5/1984 | Peterson et al. | 62/55.5 |

OTHER PUBLICATIONS

P. W. Erdman and E. C. Zipf, "Closed-Cycle Cryogenic Pump Suitable for Sounding Rockets Use", Rev. Sci. Instrum., 53(1), Jan., 1982, pp. 106-107.

*Primary Examiner*—Ronald C. Capossela

*Attorney, Agent, or Firm*—Hamilton, Brook, Smith & Reynolds

[57] ABSTRACT

An oil free vacuum system 10 which comprises a high thermal capacitance cryopump 12 and air ejector 38. The air ejector 38 is used to reduce load lock chamber 16 pressure to an intermediate vacuum. Cryopump 12 further evacuates chamber 12 to the operating vacuum of a work chamber 14. The work chamber 14 is maintained at high vacuum by a main cryopump 20. The main cryopump can be started in an oil free manner through the use of air ejector 38 and high thermal capacitance cryopump 12. A high themal capacitance, high thermal conductance cryopanel is formed of a lead/copper sandwich.

22 Claims, 4 Drawing Figures

OIL FREE VACUUM SYSTEM

DESCRIPTION

1. Technical Field

This invention relates to cryopumps, specifically to cryopumps used in applications where a work chamber must be operated at high vacuum in extreme cleanliness.

2. Background

Cryopumps are frequently used to remove gases from work environments and maintain them at high vacuum. Many processes require a near perfect vacuum for good results. Further, best process results and manufacturing efficiencies are often achieved where a vacuum is continuously maintained in the work space. In this way, uniform and repeatable processes may be performed without interruption. Recently, the increasing miniaturization of electronic components manufactured in vacuum has increased the sensitivity of those components to minute amounts of contaminants.

Vacuum manufacturing working environment pressures are typically held below $5\times10^{-7}$ torr. In most manufacturing operations, however, it is necessary to transfer materials into and out of the high vacuum work space. Conventionally, this may be done in two manners. The simplest method is to place the work material into the vacuum chamber at atmospheric conditions. The vacuum chamber is then evacuated prior to manufacture. This period of evacuation is often lengthy and does not always achieve optimum conditions in the work space. An alternative to this approach is to utilize a vacuum load lock adjacent to the vacuum work chamber. The load lock is used to move material into and out of the work space while maintaining the work space at high vacuum. In such a system raw material is placed in the load lock at ambient conditions after which the load lock is evacuated to an intermediate crossover pressure by a roughing pump. The load lock is then further evacuated to a high vacuum state by a small auxiliary cryopump. After the load lock space has been fully evacuated, it is opened to the work space and the raw material is transferred into the work space.

The roughing pumps required to evacuate load locks to intermediate pressures are typically oil lubricated piston pumps. Each time material is brought into the load lock, the piston pump is used to provide a rough vacuum, or crossover pressure required for activation of the auxiliary cryopump. To enable a conventional cryopump to repeatably evacuate a typically sized load lock of 10–15 liters, a crossover pressure of about 3–12 torr is required.

At low pressures, oil vapor is released from the roughing pump and can enter the load lock by backmigration. Therefore, some small amount of contamination can occur, and oil vapor mixed with residual atmosphere gases can persist in the load lock after its completed evacuation in amounts that are unacceptable for semiconductor manufacture. These residual gases are released into the work space when manufacturing material is transferred from the load lock into the work space. Thus, the work space can continually receive small amounts of contaminants which degrade work space cleanliness and lowers work space product quality.

Typically, pump pressures above 200 millitorr will keep the oil in the roughing pump in the transitional and viscous ranges which minimizes contamination. Unfortunately, it is difficult to accurately limit the roughing pressure and lower pressures can result in molecular backstreaming of roughing pump oil resulting in increased work space contamination.

An object of this invention, therefore, is to provide a substantially oil free cryogenic vacuum system. Such a system would eliminate oil contamination from the work chamber.

Lubricated piston pumps are also required for initial start-up of warm cryopumps. To start a cryopump, a rough vacuum pressure of less than 50 millitorr must be established. Since roughing pumps are usually limited to minimum pressures of about 200 millitorr in order to minimize the effects of oil backstreaming, this lower start-up pressure results in the introduction of some contaminating oil vapor into the cryopump system.

Another object of this invention is to provide a method of oil free cryopump start-up.

SUMMARY OF THE INVENTION

The invention comprises a vacuum system and method of operation which permit oil free start up of a work chamber cryopump and oil free continued operation of the system. The vacuum system comprises a work chamber and a load lock for transferring material into and out of the work chamber. The work chamber is positioned for fluid communication with a work chamber cryopump whereas the load lock is positioned for fluid communication with a second cryopump and a gas ejector.

In the preferred embodiment of the vacuum system the second, or load lock, cryopump is a high thermal capacitance cryopump. The high thermal capacitance allows it to quickly accept a high thermal load of about 100 torr-liter or greater and a high thermal conductance allows rapid recovery. A thermal capacitance of about six joules/°Kelvin or greater in the temperature range of 8 to 20 K. can be obtained without a substantial increase in the volume of the pump by forming the coldest cryopanel array at least in part of a material of high specific heat in that temperature range. Best performance is obtained with a material characterized by a capacitance per unit volume of about 0.2 joule/cubic centimeter-Kelvin.

In a preferred embodiment of the high thermal capacitance cryopump, it comprises a low temperature adsorptive array constructed both of a highly conductive metal and lead. The lead can be alloyed with antimony to increase hardness and either bonded to a single layer of conductive metal or sandwiched between two layers of the conductive metal. If the lead has any exposed surface area it can be nickel plated to decrease its emissivity.

The method of oil-free work chamber cryopump start-up comprises the step of initially using the air ejector to evacuate the work chamber cryopump to an intermediate pressure. The previously started load lock cryopump is then used to further evacuate the work chamber cryopump to a vacuum sufficient for cryopump start-up.

The method of oil free vacuum system operation comprises as a first step placing raw material to be processed in the load lock. The load lock air pressure is then reduced to a crossover pressure by the air ejector after which the high thermal capacitance cryopump evacuates the chamber to a vacuum system operating pressure. The load lock and work chamber are then coupled and the raw material is transferred to the work chamber.

BRIEF DESCRIPTION OF THE DRAWINGS

The foregoing and other objects, features, and advantages of the invention will be apparent from the following more particular description of the preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Prior to exposure to a work chamber or load lock, the coldest stage of a cryopump such as described herein is cooled to about 10 K. which provides a pressure of about $10^{-7}$ torr ($10^{-4}$ millitorr) in the cryopump chamber. At crossover in a conventional cryopump system, the cryopump is opened to the work chamber or load lock and exposed to the crossover gases. To reduce the pressure of the work chamber or load lock to $10^{-7}$ torr, the gases must be condensed onto the cryopump by extraction of thermal energy. That thermal load raises the coldest stage temperature to about 20 K. The temperature is then drawn back down to about 10 K. for a final pressure of about $10^{-7}$ torr. The thermal load on the cryopump during crossover can be specified in torr-liters, the product of crossover pressure and work chamber or load lock volume. The torr-liter load can be directly equated with energy to be absorbed by the cryopump in joules by the relationship:

joules=0.7 torr-liter of nitrogen

If a large quantity of gas and therefore substantial thermal energy remains in a partially evacuated load lock chamber, an excessive temperature excursion may occur in a cryopump exposed to such a chamber. Such temperature excursions can render cryopumps inoperable by liberating condensable and noncondensable gases from the cryopump's coldest stage. These liberated gases destroy the cryopump's insulating vacuum, which further heats the cryopump. To achieve a successful crossover, the residual thermal energy of the vacuum load lock must be minimized to prevent the coldest temperature array of the cryopump from exceeding 20 K. Above 20 K., noncondensable gases such as hydrogen are released by the cryopump's charcoal adsorbent. This release of gas can result in a cascading increase in cryopump temperature which eventually returns the cryopump to virtually ambient pressures.

In conventional load lock vacuum systems, oil lubricated pumps have been chosen as roughing pumps because of their ability to achieve relatively low pressures which minimize the thermal load at crossover. Other pumps have proven incapable of achieving the low intermediate pressures of about 200 millitorr required by conventional load lock cryopumps for repeated exposure.

Figure 1:
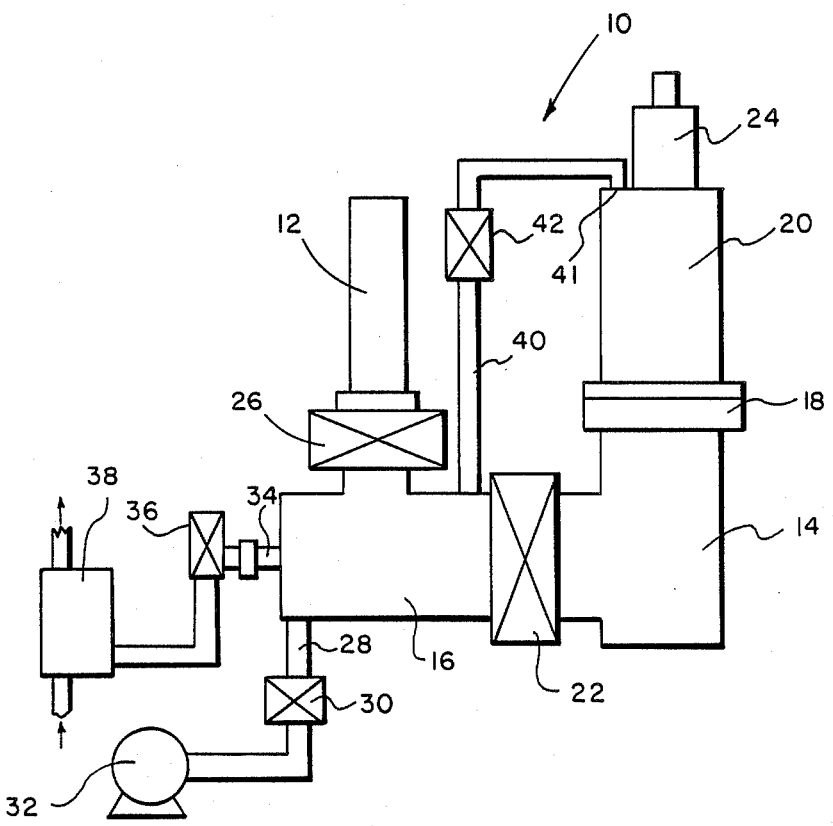
FIG. 1 is a schematic representation of a cryopump system with a load lock incorporating principles of the invention.

FIG. 1 illustrates an oil free vacuum system 10 which incorporates the use of a high thermal capacitance cryopump 12 and an air ejector 38. These two elements replace the conventional oil lubricated roughing pump in normal vacuum system operations.

The vacuum system 10 is designed to be used for manufacturing processes in which material is repeatedly moved into and out of vacuum process chamber 14. The system is particularly appropriate for manufacturing operations requiring extremely clean high vacuum conditions.

The vacuum system installation 10 includes a work chamber 14 and a load lock 16. The work, or process, chamber 14 is maintained at a high vacuum by a conventional cryopump 20. The passage between the cryopump 20 and process chamber 14 may be closed or modulated through the use of a throttle valve 18. Process chamber 14 is selectively connected to the load lock 16 through valve 22.

In normal operations, manufacturing material is placed in a load lock chamber 16 at ambient pressure. The load lock is evacuated to an intermediate crossover pressure by air ejector 38 and then to a high vacuum by high thermal capacitance cryopump 12. Valves 36 and 26 isolate the air ejector 38 and cryopump 12 from the load lock chamber 16 when they are not in use. Only after the load lock 16 has achieved a vacuum state approaching that of previously evacuated process chamber 14 is valve 22 opened to allow passage of raw material from the load lock to the process chamber.

This method of operation permits movement of raw material into the work chamber without use of an oil lubricated pump. In conventional vacuum systems the load lock would be evacuated to intermediate crossover pressure by an oil lubricated roughing pump. In this system the air ejector 38 is used instead of such a pump. However, the ejector is not capable of obtaining the high vacuum obtained with an oil pump. In order to compensate for the relatively high crossover pressure (8 torr) to which the air ejector is limited the high thermal capacitance cryopump 12 is used. This cryopump 12, described below, withstands relatively high crossover pressures.

After processing is completed, valve 22 is reopened and the processed material is removed from the process chamber 14 through load lock 16. When valves 22 and 26 are closed, chamber 16 can be opened to atmosphere for removal of material. Since no oil lubricated pump is used in the movement of material, manufacturing materials can be continually brought into and out of the process chamber without risk of oil contamination.

Although, in the system illustrated, material is brought into and taken out of the work chamber 14 through the load lock 16, in certain continuous operations, it is advantageous to locate an output load lock to the right of chamber 14 to facilitate rapid material movement.

An oil lubricated starting pump 32 is only utilized in initially starting the load lock cryopump. Starting pressure for a cryopump is about 50 millitorr. Conventional cryopumps will not generally start at higher pressures, although once started and cooled down they are able to tolerate somewhat higher pressures. During start up, the temperature of the cryopump must be reduced from ambient temperature. To obtain that temperature drop, the heat drawn by the refrigerator must substantially exceed the heat transfer from the environment. Evacuation of passage 47 (FIG. 2) to 50 millitorr sufficiently insulates the cryogenic refrigerator 64 from the ambient environment. On the other hand, once the cryopump is started and stabilized, its pressure is about $10^{-7}$ torr and its temperature is about 10 K. When the valve is opened to the load lock, a substantial vacuum is maintained in passage 47. Before the pressure in the passage 47 is able to increase to a level at which heat transfer from the environment presents a problem, the cryopump is able to rapidly absorb the thermal load from the load lock with an increase in temperature of only 10 K. Even at that increased temperature, the cryopump is able to maintain a sufficient vacuum.

The cryopump is able to rapidly absorb the heat load due to a sufficient thermal capacitance. Thermal capacitance measures the ability of material to store internal energy with a change in temperature when the material receives a net flow of heat. Thermal capacitance is analogous to the inertia of a mass. It allows the operating cryopump to temporarily accept more energy than the cryopump refrigerator can immediately absorb and yet continue to operate at low temperatures.

In order to start the load lock cryopump 12 the starting pump 32 is used to bring the pressure in the load lock and cryopump 12, which are isolated by valves 22 and 34, to about 50 millitorr. After the load lock cryopump 12 has been successfully started, valve 30 is closed and oil lubricated starting pump 32 is removed from the system. In a vacuum system incorporating this invention, no further use is made of an oil lubricated pump. The high thermal capacitance of the now operating high thermal capacitance cryopump 12 is relied upon to accept relatively large thermal inputs. If an air ejector could be made to draw a sufficient vacuum, the piston pump 32 might even be eliminated from start-up operations.

In order to start the main cryopump 20, high thermal capacitance cryopump 12 is isolated from the load lock through valve 26. The load lock, however, is opened to cryopump 20 through line 40, valve 42 and secondary cryopump port 41. Valve 18 is closed during starting so that work chamber cryopump 20 is isolated from the work chamber 14. The air ejector 38 is used to bring load lock 16 and cryopump 20 down to a vacuum of 8 torr (8,000 microns). Valve 36 is then closed to remove the ejector from the system. High thermal capacitance cryopump 12 which has been previously started is then used to evacuate the chamber 16 and main cryopump 20 to a vacuum pressure of less than 50 microns, at which point cryopump 20 is started. The high thermal capacitance of the cryopump thereby effectively replaces the oil lubricated starting pump for the purpose of starting the work chamber cryopump. This start-up assures that the work chamber cryopump will be absolutely oil free and clean for purposes such as integrated circuit manufacture.

After having thus started both cryopumps, process chamber 14 can be opened to load lock chamber 16 through valve 22 and evacuated to cross over pressure by air ejector 38. After the air ejector 38 is eliminated from the system by valve 36, the high thermal capacitance cryopump 12 is used to reduce the process chamber 14 pressure to a high vacuum. Valve 18 is then opened to allow the main cryopump 20 to maintain the vacuum in chamber 14 during manufacturing. It is thus shown how both the conventional work chamber cryopump 20 and process chamber 14 are brought to a very high state of vacuum with virtually no chance of oil contamination.

Figure 3:
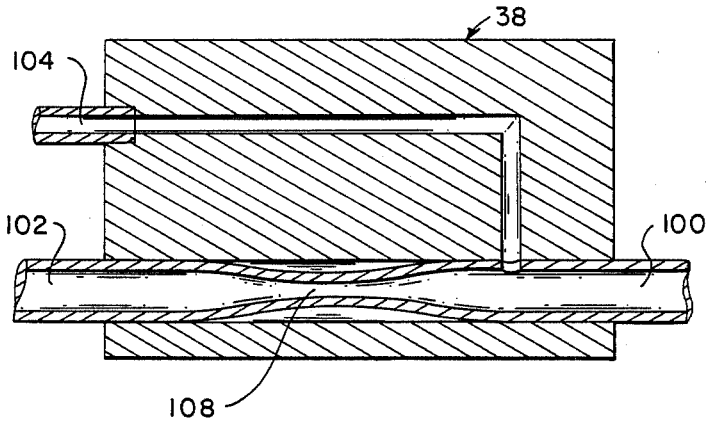
FIG. 3 is a cross section of an air ejector for use as a roughing pump in the cryopump system of FIG. 1.

FIG. 3 is a cross section of the air ejector 38 utilized in this system instead of an oil lubricated roughing pump. The Ultra Vac TM air ejector used in this system is available from Air-Vac Engineering Co., Inc., 100 Gulf St., Milford, Conn. 06480. The Ultra Vac TM air ejector 38 is capable of evacuating a vacuum chamber down to 8 torr.

Air ejectors operate on the Venturi suction principle whereby a high pressure air supply acts as a gas molecule transport medium for the creation of a vacuum. A pressurized air supply enters the air ejector through line 100 and leaves or exhausts through line 102. Vacuum line 104 enters at a section of the passage between the air entrance and exit. At this portion of the air ejector, air speed increases due to the narrowness of the passage 108. With the increase in air velocity, the pressure at that point in the line is drastically reduced. It is this drastic reduction in pressure that draws down the pressure in the vacuum line 104 and the chamber to which it is connected.

Air ejectors are extremely clean and oil free. Generally speaking, the air supply through line 100 should be filtered, but in any case, air traveling from entrance to exit 100 to 102 does not flow through line 104. Therefore, an air ejector of this type cannot contaminate the vacuum chamber. In this way air ejectors create vacuum conditions with virtually no contamination.

The high thermal capacitance cryogenic pump 12 is used in this system because current air ejectors are unable to achieve sufficient vacuum pressure for conventional cryopump start up and continued operation. This air ejector, however, does achieve a very high vacuum, 8 torr, as compared to other air ejectors and the high thermal capacitance of cryopump 12 is capable of repeated usage at about 8 torr to further evacuate the load lock 16.

Figure 2:
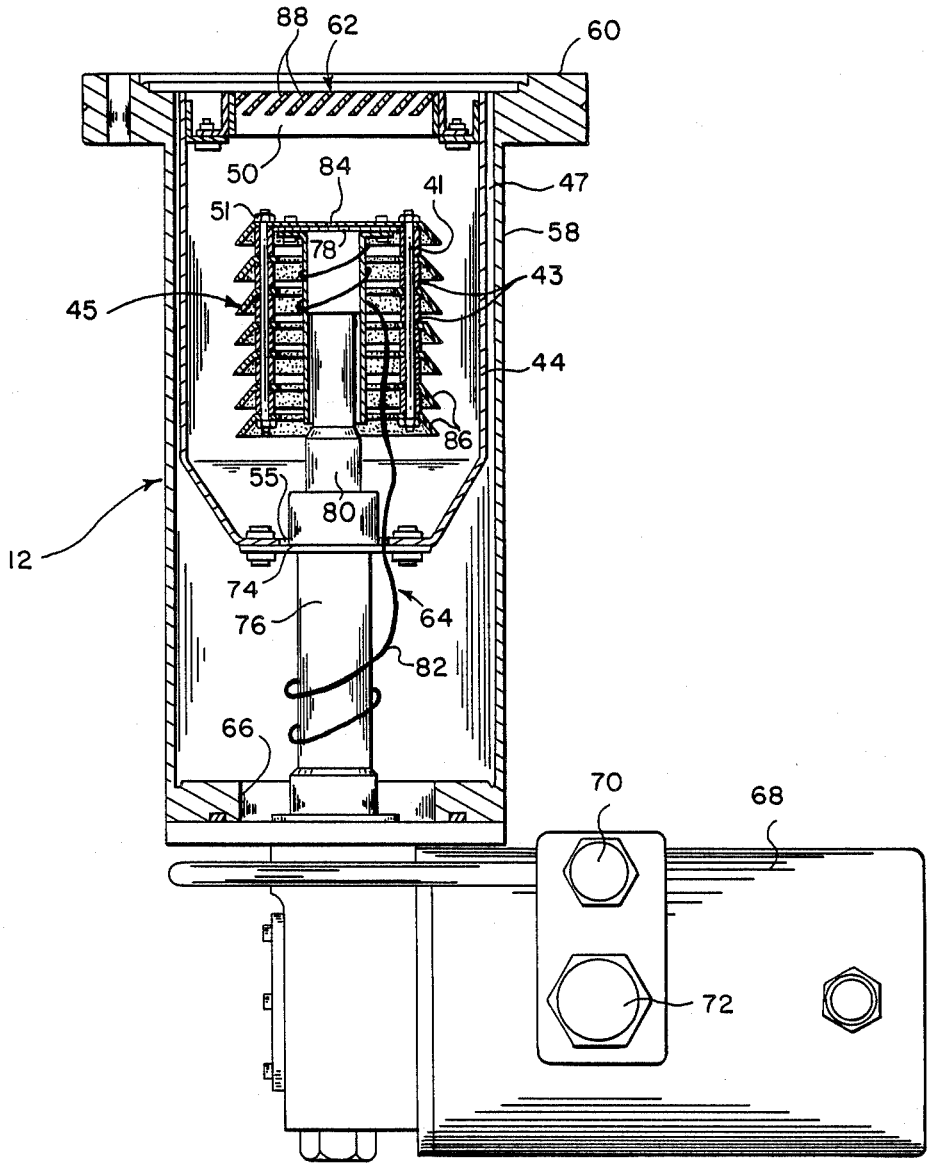
FIG. 2 is a cross section of a cryopump with a high thermal capacitance for use with the load lock of FIG. 1.

A detailed description of the high thermal capacitance cryopump 12 used in conjunction with the air ejector may be understood with reference to FIG. 2 where the cryopump is shown in an expanded cross section. The cryopump 12 comprises a vacuum vessel 58 which is mounted along flange 60 to valve 26 adjacent to load lock 16. A front opening 62 in the vessel 58 communicates with a circular opening in the valve 26.

A two stage cold finger 64 of a refrigerator protrudes into the vessel 58 through an opening 66. In this case, the refrigerator is a Gifford-MacMahon refrigerator such as disclosed in U.S. Pat. No. 3,218,815 to Chellis et al., but others may be used. The two stage displacer in the cold finger 64 is driven by motor 68. With each cycle, helium gas is introduced into the cold finger under pressure through line 70. In the cold finger the helium is expanded and thus cooled. The helium is then exhausted through line 72.

A first stage heat sink, or heat station, 74 is mounted at the cold end of the first stage 76 of the refrigerator. Similarly, a second stage heat sink 78 is mounted to the cold end of the second stage 80. A suitable temperature sensor 82 is mounted at the rear of heat sink 78.

A cup-shaped radiation shield 44 is mounted to the first stage, high temperature heat sink 74. The second stage 80 of the cold finger extends through an opening 55 in the radiation shield. This radiation shield 44 surrounds the second stage array 45 to minimize heating of the array by thermal radiation. Preferably, the temperature of the radiation shield is less than 120° K.

A frontal cryopanel array 88 is connected to the main first stage radiation shield 44 and serves as both a radiation shield for the primary (second stage) cryopanel 45 and as a cryopumping surface for higher boiling temperature gases such as water vapor. The radiation shield 44 both supports the frontal array 88 and serves as the thermal path from the heat sink 74 to the array. The frontal array 88 shown in FIG. 2 comprises louvers joined by a rim 50. The configuration of this array need not be confined to the arrangement shown but can be any array of baffles arranged to act as a radiant heat shield and a higher temperature cryopumping panel while allowing passage of lower condensing temperature gases to the second stage array 45.

The second stage array 45 forms the primary pumping surface of the cryopump and is mounted to heat sink 78. It is in this second stage array that this cryopump differs from conventional cryopumps for enhanced capability to handle higher crossover pressures. The second stage array 45 comprises a disk 84 and a set of circular chevrons 86 arranged in a vertical stack and mounted to the disk by struts 41. The struts 41 extend through the chevrons 86 and cylindrical spacers 43 between the chevrons. Nuts 51 at the ends of the struts compress the chevrons and spacers into a tight stack.

The innermost surface of the chevrons 86 may be covered with charcoal 90 which acts as a low temperature adsorbent for collection of low boiling point gases. Low boiling point gases contact the adsorbent charcoal by passing between the open chevrons 86. This open arrangement with the chevrons supported by struts allows for simple assembly and free flow of non-condensing gases to the adsorbent.

Figure 4:
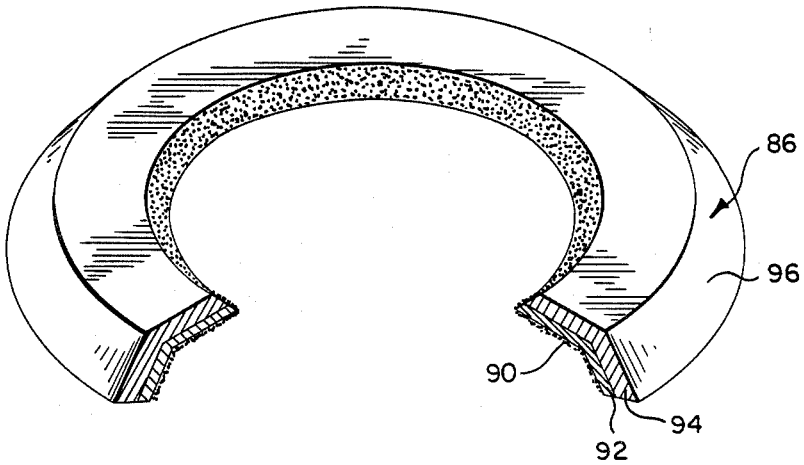
FIG. 4 is a perspective view, partially broken away, of a second stage chevron of the high thermal capacitance cryopump disclosed in FIG. 2.

FIG. 4 is a perspective cutaway of a single chevron 86 of the array 45. The chevron described in reference to FIG. 4 is designed to accept a high thermal load. Inclusion of these chevrons into the cryopump 12 triples cryopump capacity as compared to conventional chevrons. This enables the cryopump to operate in the oil free system described with reference to FIG. 1.

The chevron 86 is made up of at least three layers of material, a highly conductive metal layer, a high density lead layer and the layer of charcoal adsorbent.

At least one layer 72 of each chevron 86 is made from a highly conductive metal such as copper. It is important that heat energy introduced into the cryopump be quickly transferred to the cryogenic refrigerator, or cold finger 64, so that it can be removed and the second stage temperature can be rapidly returned to about 10 K. after crossover. It is for this reason that conventional chevrons in cryopumps are constructed of copper.

Conventional chevrons are constructed of thin sheets of copper. In small cryopumps which are typically used with load locks, the chevrons do not have a substantial amount of thermal capacitance in the operating temperature range of 8 K. to 20 K. since they have a low mass and a low specific heat at those temperatures. The load lock cryopump of this system requires large thermal capacitance to store the substantial energy to which the load lock cryopump is exposed, with a minimum increase in temperature, until the cryogenic refrigerator 64 is able to remove the thermal energy from the cryopump. A significant temperature rise would result in a reduced vacuum, and the cryopump would be overwhelmed by the heat load from the environment and would cease to operate.

The thermal capacitance required to absorb a 100 torr-liter load with a temperature shift of no more than 12 K., from 8 K. to 20 K., is 70 joules/12 K., or about six joules/K. Such a second stage thermal capacitance is typically found only in large and relatively expensive cryopumps which have large refrigerators. Such a large cryopump can be used as a load lock cryopump in a system embodying this invention and may even be preferred where rapid recovery time in the order of two minutes is required. However, where a smaller volume load lock cryopump is required and a slower recovery time of about four minutes can be tolerated, the small high capacitance cryopump described above is preferred.

The chevrons 86 are made to incorporate a material with a high thermal capacitance per unit volume at cryogenic temperatures. The most common such material is lead. New materials have recently been devised, however, that have thermal capacitances approaching lead. Examples of such materials include the intermetallic compounds of rare earths described in U.S. Pat. No. 4,082,138 to Miedema and the thallous halides and specialty ceramics described in U.S. Pat. No. 4,354,355 to Lawless.

The major portion of each chevron 86 in the embodiment shown, however, is constructed of high density lead 94. The lead layer serves to greatly increase chevron mass and specific heat. Since pure lead is quite soft, the lead layer is preferably mixed with a hardener such as antimony. Lead can absorb up to ten times the energy of copper in the 8 K. to 20 K. range, which is the operating range of the second stage array. The layer of lead therefore greatly increases the thermal absorption capability of the array.

Lead by itself, however, is not a good thermal conductor and is unable to provide the quick reaction time required for a cryopump. Copper can transmit about 10 watts per centimeter degree Kelvin, whereas lead is only able to transmit 0.5 watts per centimeter degree Kelvin. If the chevron array were constructed entirely of lead, a very long time period would be required for the cryopump to recover after condensing each burst of gas from the load lock due to inability of the lead to transmit the absorbed heat energy to the refrigerator quickly enough. At 20 K. the previously absorbed gases would be gradually liberated and the system vacuum might be lost. In this system, however, the layer of copper 72 or another highly conductive metal is in contact with the lead over a wide surface area. The copper provides a high conductance path from the entire mass of lead to the refrigerator and allows the cryogenic refrigerator to pull the heat energy out of the lead quickly.

This layer of copper 72, which is more than ten times more conductive than lead, allows the cryopump refrigerator to draw down the temperature of the lead evenly and rapidly. When the valve is opened between the cryopump and the load lock, the copper layer also serves to evenly distribute the heat load so that the lead can receive the heat directly and be most fully utilized as a thermal capacitor. The heat transfer into and out of the lead is greatly enhanced by the intimate contact of the lead with the copper and because the lead's ratio of surface area of thermal contact to its volume is large (greater than 20). To ensure good thermal contact between the lead and the copper, a small layer of indium can be interspaced therebetween or the lead can be rolled between two layers of copper to form a metal sandwich.

The specific amount of lead required to produce the desired thermal capacitance will vary for each high thermal capacitance cryopump and its usage. The quantity of lead is dependent on the efficiency of the gas ejector device and the size of the load lock chamber. These two factors determine the torr-liter pumping capacity required of the cryopump. The required pumping capacity must be obtained within the maximum allowable temperature excursion of the coldest array of the cryogenic refrigerator. Consideration of these factors either empirically or theoretically reveals the minimum thermal capacitance required for a specific usage. On the other hand, an increased amount of lead increases the recovery time required to cool the cryopump from 20 K. to about 10 K. The conductance of the array, based on materials and configuration, must be sufficient for rapid cooldown.

As stated above, the second stage of the cryopump is best maintained at about 8 to 20 degrees Kelvin. At greater than 20 K., gases adsorbed by the adsorbent charcoal are liberated. The maximum allowable temperature excursion of the second stage chevron is therefore about 12 K. The lead and copper chevrons keep the second stage array of the high thermal load cryopump 12 from exceeding 20 K. even when used in conjunction with an air ejector.

Thermal capacitance is determined by the mass and specific heat of the materials of which the cryopump is constructed. Specifically, capacitance in joules/degree Kelvin is the product of specific heat in joules/K.-gram and mass in grams. It should be recognized that any given thermal capacitance can be obtained with a sufficient amount of any material. However, too great a volume of such material would result in an unsatisfactory increase in size of the array. Therefore, a key advantage in the use of materials such as lead in the array is that the capacitance per unit volume of material is high. Capacitance per volume in joules/K.-cubic centimeter is equal to the product of the specific heat of the material in joules/K.-gram and density of the material in grams/cubic centimeter. The density of lead is 11.34 g/cm$^3$ and is somewhat greater than the density of copper which is 8.9 g/cm$^3$. Thus, the added density of lead contributes to the increased capacitance per volume. Further, lead has a significantly greater specific heat than copper in a temperature range of 8 to 20 K.

The effective specific heat of a material over a temperature range can be defined as the ratio of the change in enthalpy of the material over that temperature range to the change in temperature. Thus, for lead the effective specific heat over the temperature range 8 K. to 20 K. is:

$$C_{8-20K} = (h_{20} - h_8)/\Delta T$$

$$= \frac{.354 \text{ joules/g}}{12\text{K}}$$

$$= .0295 \text{ joules/g-K}$$

For lead, the product of density and effective specific heat is equal to $11.34 \times 0.0295 = 0.3345$ joules/K.-cm$^3$.

By comparison, the change in enthalpy of copper through the temperature range of 8 K. to 20 K. is 0.033 joules/gram so the effective specific heat of copper through that temperature range is 0.00275 joules/g-K. and the product of density and effective specific heat is 0.0245 joules/K.-cm. Thus the thermal capacitance per volume of lead in the temperature range of 8 K. to 20 K. is more than an order of magnitude greater than that of copper.

In order to provide the significantly increased capacitance per unit volume of the array to handle the greater torr-liter loads when an ejector is used, the capacitance per volume of the material used in the array should be an order of magnitude greater than that of copper, or at least about 0.2 joules/K.-cm$^3$. Using materials of thermal capacitance per volume less than that would result in excessively large arrays in handling thermal loads of 100 torr-liter or greater because the thermal capacitance required to handle 100 torr-liter in a temperature range of 12 K. is about six joules/K.

A further advantage of using lead to provide the high thermal capacitance of the array is that at room temperature the specific heat of lead is actually less than that of copper. Thus, even with the greater density of lead the capacitance of the array at room temperature is not increased substantially at room temperature. As a result the cool-down time for a cryopump incorporating lead in the array as described has only increased from about 84 minutes to about 95 minutes.

An important consideration in the construction of a chevron array comprising lead is the emissivity of the lead. Generally, shiny surfaces, such as given by nickel plated copper, are used in cryopump arrays to reject direct heat radiation which causes increased temperatures. Lead typically is a dark colored metal and therefore would absorb direct radiation. For this reason, the lead layer 94 in this array is nickel plated at its exposed surface 96 unless it is completely covered by copper layers. In this way, emissivity is decreased to a level similar to that of conventional copper chevrons.

The multilayer chevron 86 has therefore been constructed to both increase the cryopump's thermal load capability and retain the heat conductance advantages of conventional copper chevrons. Since the second stage array normally operates at about 8 K., the high thermal load array restrains the array's temperature excursion from the crossover gas to less than 12 K. in order to prevent deadsorption of noncondensable gases. It should be further noted that the highly conductive layer 92 of the chevron allows rapid repeated cycling of the load lock which increases speed and efficiency of material processing.

In a prototype high thermal capacitance cryopump built according to the principles of this invention 240 grams of lead were used in the chevrons which increased the cryopump mass to 388 grams. The cryopump capacity was thereby increased from 40 torr liters to 150 torr liters. The maximum temperature of the coldest temperature array was kept below 20 K., and therefore gas deadsorption during load lock cycling was minimal. The high thermal load cryopump was therefore able to operate repeatedly with an air ejector without producing chamber contamination or resulting in cryopump degradation.

While the invention has been particularly described with reference to the preferred embodiment therefore, it will be understood by those skilled in the art that various changes can be made therein without departing from the scope of the appended claims. For example, the high load cryopump could also be used in conjunction with an oil lubricated roughing pump limited to a high crossover pressure to decrease the amount of vacuum system oil contamination.

We claim:

1. A vacuum system comprising:
   a. a work chamber;
   b. a load lock for receiving material to be introduced into and removed from the work chamber;
   c. a first cryopump for fluid communication with the work chamber;
   d. a second cryopump for fluid communication with the load lock through a valve; and
   e. a gas ejector for initial depressurization of said load lock to a cross-over pressure when the valve to the second cryopump is closed and materail is introduced to the load lock for transfer to the work chamber.

2. The vacuum system of claim 1 wherein said second cryopump comprises a high thermal capacitance cryopump to complete evacuation of the load lock after said gas ejector initially depressurizes said load lock.

3. The vacuum system of claim 2 wherein said high thermal capacitance cryopump comprises a low temperature adsorptive array constructed in part of lead.

4. The vacuum system of claim 3 wherein said low temperature adsorptive array further comprises a copper layer.

5. The vacuum system of claim 3 wherein said lead is alloyed with antimony to increase the lead's hardness.

6. A vacuum system as claimed in claim 2 wherein the capacitance of the high thermal capacitance cryopump is at least about six joules/K.

7. The vacuum system of claim 6 wherein the capacitance per volume of a material forming at least part of a cold stage cryopanel of the second cryopump is at least about 0.2 joules/cm$^3$-K.

8. A vacuum system comprising a cryogenic refrigerator and a low temperature cryopanel mounted to and cooled by said cryogenic refrigerator, the cryopanel being cooled to cryogenic temperatures for condensing gases thereon and thus creating a vacuum, wherein said cryopanel comprises a sheet of at least two layers, one layer formed of a material of relatively high thermal conductivity and the other layer formed of a material of relatively high thermal capacitance per unit volume.

9. The cryogenic refrigerator of claim 8 wherein said material of high thermal capacitance per unit volume is lead.

10. The cryogenic refrigerator of claim 9 wherein said highly conductive material is copper.

11. A high thermal capacitance cryopump comprising:
   a cryogenic refrigerator having at least two stages; and
   a lowest temperature cryopanel mounted to and cooled by the lowest temperature stage of said refrigerator, the cryopanel being cooled to cryogenic temperatures for condensing gases thereon; wherein said lowest temperature cryopanel has a thermal capacitance of at least about six joules/K. and comprises a sheet of sandwiched layers, one layer formed of a material of high thermal conductivity and the other layer formed of a material having a capacitance per unit volume of at least about 0.2 joules/cm$^3$-K.

12. The cryopump of claim 11 wherein the material of high capacitance per volume comprises lead.

13. The cryopump as claimed in claim 12 wherein said highly conductive material comprises a layer of copper.

14. The cryopump of claim 13 further comprising a layer of indium positioned between said copper and lead layers.

15. The cryopump of claim 11 wherein the material of higher capacitance is sandwiched between two layers of said highly conductive material.

16. A method of continuously processing material in a high vacuum oil free system comprising the steps of:
   reducing the pressure in a work chamber by means of a first cryopump;
   placing said material in a load lock;
   reducing said load lock pressure to a crossover pressure by means of an air ejector device while the load lock is isolated from a second cryopump and the work chamber;
   further reducing the load lock pressure to a system operating pressure by means of the second cryopump;
   thereafter connecting said load lock at a system operating pressure to the work chamber; and
   transferring said material from the load lock to the work chamber.

17. The method of claim 16 wherein said second cryopump comprises a high thermal capacitance cryopump.

18. A vacuum system as claimed in claim 17 wherein the capacitance of the high thermal capacitance cryopump is at least about six joules/K.

19. The vacuum system of claim 18 wherein the capacitance per volume of a material forming at least part of a cold stage cryopanel of the second cryopump is at least about 0.2 joules/cm$^3$-K.

20. The method of claim 17 wherein said high thermal capacitance cryopump comprises a low temperature adsorptive array constructed in part of lead.

21. A method of starting a first cryopump comprising the steps of:
   a. evacuating said first cryopump to an intermediate pressure with an air ejector device;
   b. further evacuating said cryopump with a second cryopump; and
   c. operating said first cryopump.

22. A vacuum system as claimed in claim 1 wherein the second cryopump comprises a cryopanel cooled to cryogenic temperatures to condense gases thereon, the cryopanel comprising a sheet of at least two sandwiched layers respectively formed of a material of relatively high thermal conductivity and a material of relatively high thermal capacitance per unit volume.

* * * * *